US009472040B2

(12) United States Patent
Sato et al.

(10) Patent No.: US 9,472,040 B2
(45) Date of Patent: Oct. 18, 2016

(54) BILL RECOGNIZING AND COUNTING APPARATUS

(71) Applicant: GLORY LTD., Himeji-shi, Hyogo (JP)

(72) Inventors: Tomoyasu Sato, Himeji (JP); Shinji Matsuura, Himeji (JP); Teruo Sudo, Himeji (JP)

(73) Assignee: GLORY LTD., Himeji-shi (JP)

( * ) Notice: Subject to any disclaimer, the term of this patent is extended or adjusted under 35 U.S.C. 154(b) by 0 days.

(21) Appl. No.: 14/938,025

(22) Filed: Nov. 11, 2015

(65) Prior Publication Data

US 2016/0063794 A1 Mar. 3, 2016

Related U.S. Application Data

(63) Continuation of application No. 12/446,097, filed as application No. PCT/JP2006/321594 on Oct. 24, 2006, now Pat. No. 9,208,632.

(51) Int. Cl.

| | |
|---|---|
| ***G07F 7/04*** | (2006.01) |
| ***G07D 11/00*** | (2006.01) |
| ***G07D 7/20*** | (2016.01) |
| ***G07D 7/16*** | (2016.01) |

(52) U.S. Cl.

CPC ..... *G07D 11/0084* (2013.01); *G07D 7/168* (2013.01); *G07D 7/2075* (2013.01); *G07D 7/2083* (2013.01); *G07D 7/2091* (2013.01); *G07D 11/0027* (2013.01); *G07D 11/0039* (2013.01); *G07D 11/0048* (2013.01)

(58) Field of Classification Search

CPC ..... G07D 7/2075; G07D 7/2083; G07D 7/2091; G07D 11/0027

USPC ..... 194/206, 207; 209/534; 382/135; 235/379

See application file for complete search history.

(56) References Cited

U.S. PATENT DOCUMENTS

| | | | |
|---|---|---|---|
| 5,474,393 | A | 12/1995 | Abbott et al. |
| 5,875,259 | A | 2/1999 | Mennie et al. |
| 6,012,564 | A | 1/2000 | Mukai |
| 6,311,819 | B1 | 11/2001 | Stromme et al. |
| 2002/0008138 | A1 | 1/2002 | Yamauchi et al. |
| 2002/0056605 | A1 | 5/2002 | Mazur et al. |
| 2003/0015396 | A1 | 1/2003 | Mennie |
| 2003/0089769 | A1 | 5/2003 | Jantsch |
| 2003/0118228 | A1 | 6/2003 | Mennie et al. |
| 2005/0053183 | A1 | 3/2005 | Abe et al. |
| 2005/0060055 | A1 | 3/2005 | Hallowell et al. |
| 2005/0241909 | A1 | 11/2005 | Mazur et al. |
| 2007/0007719 | A1 | 1/2007 | Nishida et al. |

FOREIGN PATENT DOCUMENTS

| | | | |
|---|---|---|---|
| JP | 01-260593 | A | 10/1989 |
| JP | 02-022786 | A | 1/1990 |
| JP | 05-159130 | A | 6/1993 |
| JP | 09-106465 | A | 4/1997 |
| JP | 11-175805 | A | 7/1999 |
| JP | 2001-297319 | A | 10/2001 |

*Primary Examiner* — Jeffrey Shapiro

(74) *Attorney, Agent, or Firm* — Foley & Lardner LLP

(57) ABSTRACT

A bill recognizing and counting apparatus includes an operation unit that receives setting of bill processing modes including a denomination mode, a counting mode, a different-denomination recognition mode, and an authenticity determination mode; a feeding and transporting mechanism; and a control unit that performs control for changing a processing speed according to the bill processing mode. When the bill processing mode is in the counting mode, the different-denomination recognition mode, or the authenticity determination mode, the control unit increases the processing speed by setting the feeding and transporting mechanism to a higher speed than the speed set in the denomination mode. The increase in speed is in accordance with a reduced time necessary to process a reduced amount of data associated with the denomination mode.

12 Claims, 7 Drawing Sheets

BILL RECOGNIZING AND COUNTING APPARATUS

CROSS REFERENCE TO RELATED APPLICATIONS

This application is a continuation of U.S. application Ser. No. 12/446,097, filed Apr. 17, 2009, which is the National Stage Entry of PCT/JP2006/321594, filed Oct. 24, 2006, the entire contents of which is incorporated herein by reference.

TECHNICAL FIELD

The present invention relates to a bill recognizing and counting apparatus having a denomination mode for recognizing the denomination of the bill and a counting mode for performing only counting, and, more particularly to a bill recognizing and counting apparatus further having a different-denomination recognition mode for identifying a different denomination and an authenticity determination mode for determining authenticity, in addition to the above modes, and being constructed such that processing speed is changed according to these modes.

BACKGROUND ART

Although it is slightly different from an object of the present application, as an apparatus that changes transport speed of bills according to a manual operation or an automatic operation, for example, there is an apparatus described in Japanese Patent Application Laid-open No. H5-159130.

The technique disclosed in the above publication attempts to suppress the occurrence of faults such as jamming as much as possible at the time of the automatic operation in a bill processing apparatus, by increasing the transport speed at the time of a manual operation and decreasing the transport speed at the time of an automatic operation considering a relation between the transport speed and the fault incidence such as jamming.

While bill recognizing and counting apparatus are used at branches of a bank, processing manners are different between during and after the banking hours. Specifically, during the banking hours, bills of various denominations are processed in a mixed state, whereas after the banking hours, a main process is an operation for confirming the number of bills, which have been sorted out for each denomination.

That is, denomination recognition is essential in the processing during the banking hours, whereas a high-speed counting function is desired for the processing after the banking hours.

Conventional bill recognizing and counting apparatus have a denomination mode for performing the denomination recognition and a counting mode in which the denomination recognition is not performed. However, even in the counting mode in which the denomination recognition is not performed, the number of bills processed per unit time is the same as that of the denomination mode, and a bill recognizing and counting apparatus having a high-speed counting function incorporated therein has not been realized yet.

DISCLOSURE OF INVENTION

The present invention directs attention to the fact that functions desired for the bill recognizing and counting apparatus are different between during and after the banking hours.

In addition, in a denomination mode, it is difficult to increase the processing speed due to restrictions in data processing for the denomination recognition. However, in the counting mode without the denomination recognition, the processing speed can be increased because there is no restriction in the data processing. From this viewpoint, it is attempted to change the processing speed according to the mode. Further, a confirming operation of the bills sorted out for each denomination includes an operation for checking different denomination mixing (an operation for checking whether bill(s) of a different denomination is mixed in a bundle of bills), and an operation for checking if all the bills are genuine bills, in addition to the operation for confirming the number of bills. The present invention aims at efficient and high-speed processing using a single machine in which a mode capable of performing these confirming operations individually is provided.

The conventional technique, that is, the technique for changing the transport speed of bills according to a manual operation or the automatic operation does not take such an aim into consideration, and still performs the denomination recognition regardless of the transport speed.

In view of the above circumstances, an object of the present invention is to provide a bill recognizing and counting apparatus capable of performing operations for different purposes between during and after the banking hours at bank branches or the like efficiently and quickly by a single machine.

A bill recognizing and counting apparatus according to an aspect of the present invention includes an operation unit that receives setting of bill processing modes including a denomination mode for recognizing a denomination, a counting mode for performing only counting, a different-denomination recognition mode for recognizing a different denomination, and an authenticity determination mode for determining authenticity; a feeding and transporting mechanism having a continuously or two or more discretely variable speed function; and a control unit that performs control for changing a processing speed, which indicates number of bills to be processed per unit time, according to the bill processing mode. When the bill processing mode is in the counting mode, the different-denomination recognition mode, or the authenticity determination mode, the control unit increases the processing speed by setting the feeding and transporting mechanism to a higher speed than a speed set in the denomination mode. The increase in speed is in accordance with a reduced time necessary to process a reduced amount of data associated with the denomination mode.

In the bill recognizing and counting apparatus, when the bill processing mode is in the counting mode, the different-denomination recognition mode, or the authenticity determination mode, the control unit may reduce the data processing amount in a counting process of the bills, by not performing a denomination recognition process. In the bill recognizing and counting apparatus, the processing speed may also be set to be 720 sheets/minute in the denomination mode, and the processing speed is set to be 1200 sheets/minute in the counting mode, the different-denomination recognition mode, and the authenticity determination mode.

A bill recognizing and counting apparatus according to another aspect of the present invention includes a transport-path switching mechanism that switches a route of a bill from a main transport path to a branched transport path; a detecting unit that detects a skew of the bill; an operation unit that receives setting of bill processing modes including a denomination mode for recognizing a denomination, a counting mode for performing only counting, a different-denomination recognition mode for recognizing a different denomination, and an authenticity determination mode for determining authenticity; and a control unit that, when a bill in a skewed state exceeding a predetermined criterion is detected by the detecting unit in the denomination mode, drives the transport-path switching mechanism to guide the bill to a rejecting unit through the branched transport path, and that, when the bill processing mode is in each mode of the counting mode, the different-denomination recognition mode, and the authenticity determination mode, prohibits a switching operation to the branched transport path by the transport-path switching mechanism, so that bills including a bill in the skewed state are guided to a normal bill stacker at all times in the each mode. In the bill recognizing and counting apparatus, when detecting a bill not satisfying a predetermined condition in the counting mode, the different-denomination recognition mode, or the authenticity determination mode, the control unit may set an error flag indicating abnormality detection and stops the machine.

A bill recognizing and counting apparatus according to still another aspect of the present invention includes a transport-path switching mechanism that switches a route of a bill from a main transport path to a branched transport path; a detecting unit that detects a skew of the bill; a control unit that, when a bill in a skewed state exceeding a predetermined criterion is detected by the detecting unit (VP1), drives the transport-path switching mechanism to guide the bill to a rejecting unit through the branched transport path; and an operation unit that receives setting of bill processing modes including a denomination mode for recognizing a denomination, a counting mode for performing only counting, a different-denomination recognition mode for recognizing a different denomination, and an authenticity determination mode for determining authenticity. A criterion in the denomination mode set as the predetermined criterion is different from a criterion in each mode of the counting mode, the different-denomination recognition mode, and the authenticity determination mode set as the predetermined criterion. The criterion in the each mode of the counting mode, the different-denomination recognition mode, and the authenticity determination mode is set more lenient than the criterion in the denomination mode. The control unit performs a detecting process of the skewed state according to the criterion in the mode.

In the bill recognizing and counting apparatus, when the bill in the skewed state is detected in the denomination mode, the control unit may set a switching timing to the branched transport path by driving the transport-path switching mechanism to be earlier than normal.

EFFECT OF THE INVENTION

According to an embodiment of the present invention, the processing speed is made different between the denomination mode and each mode of the counting mode, the different-denomination recognition mode, and the authenticity determination mode. Accordingly, the processing speed is specified only by designating the mode, which is convenient for use. Further, by selecting the corresponding mode when the denomination recognition function is not required, high-speed processing (a counting process, a different-denomination identifying process, or an authenticity determining process) can be performed.

According to an embodiment of the present invention, the processing speed in the counting mode, the different-denomination recognition mode, and the authenticity determination mode can be further increased.

According to an embodiment of the present invention, the switching operation to the branched transport path is prohibited in the counting mode, the different-denomination recognition mode, and the authenticity determination mode. Accordingly, when double feed occurs in which two or more bills are stacked on each other and transported, the occurrence of jamming in a branching unit can be prevented.

According to an embodiment of the present invention, a lenient criterion for rejection upon transport of a bill in a skewed state is set in the counting mode, the different-denomination recognition mode, and the authenticity determination mode. Accordingly, an opportunity of driving the branching member constituting the transport-path switching mechanism can be reduced, thereby enabling to reduce the occurrence of jamming.

According to an embodiment of the present invention, the branching member can be driven quickly before a bill in a skewed state reaches there, thereby enabling to prevent jamming in a branching unit in the denomination mode.

BEST MODE(S) FOR CARRYING OUT THE INVENTION

Figure 1:
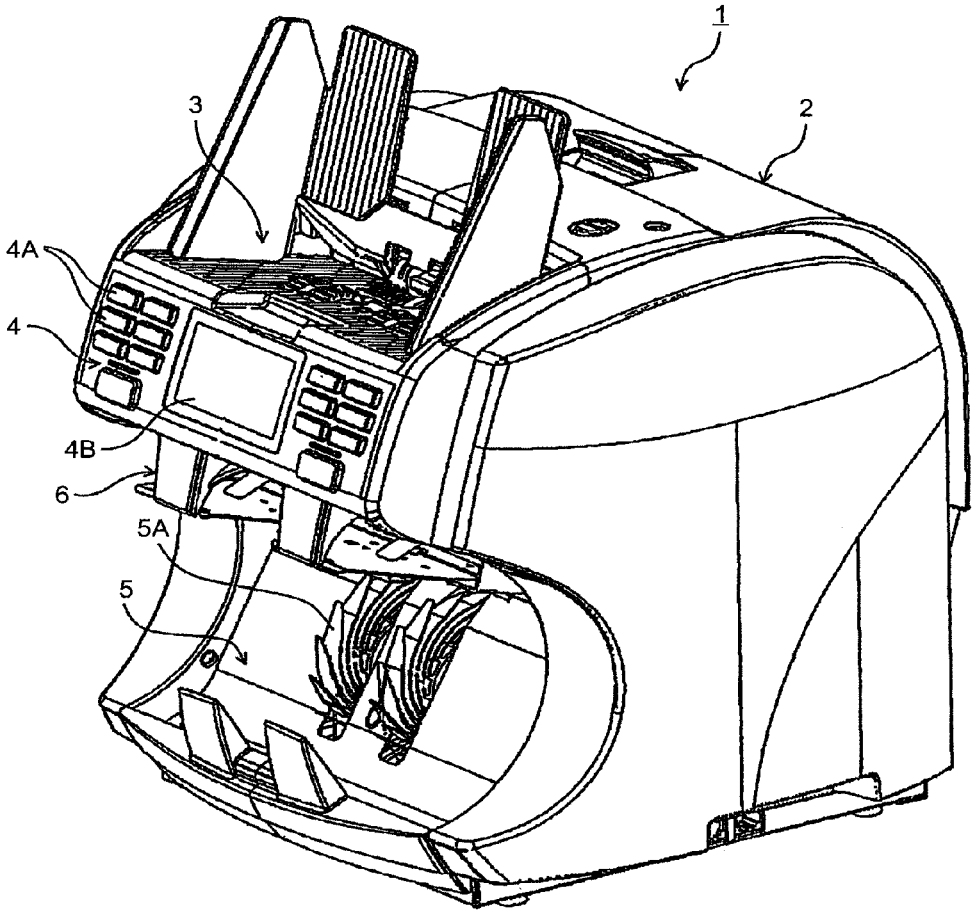
FIG. 1 is an external perspective view of one example of a bill recognizing and counting apparatus according to the present invention.

FIG. 1 is a perspective view of an exterior of a bill recognizing and counting apparatus to which the present invention is applied. In FIG. 1, a bill recognizing and counting apparatus 1 includes a hopper 3, onto which bills are filled in a stacked state, on an upper front of a casing 2, and an operation display unit 4 that performs various setting at the time of performing a counting and recognizing process of the bills and displays a processing state thereof below the hopper 3 at the front of the casing 2. The operation display unit 4 includes a plurality of operation buttons 4A for performing input of a processing operation, and a display panel 4B for displaying input information by the operation buttons 4A and a counting state, so that a bill recognizing and counting process of, for example, bills of different countries is performed by an input operation of the operation buttons 4A.

The bill recognizing and counting apparatus 1 also includes a stacker 5, in which the counted bills are aligned and stacked, on a lower front of the casing 2, and a rejecting unit 6 in which bills excluded from a counting target are stacked, above the stacker 5. A member indicated by reference character 5A is an impeller that catches the bills transported to the stacker 5 to align and stack the bills in the stacker 5.

Figure 2:
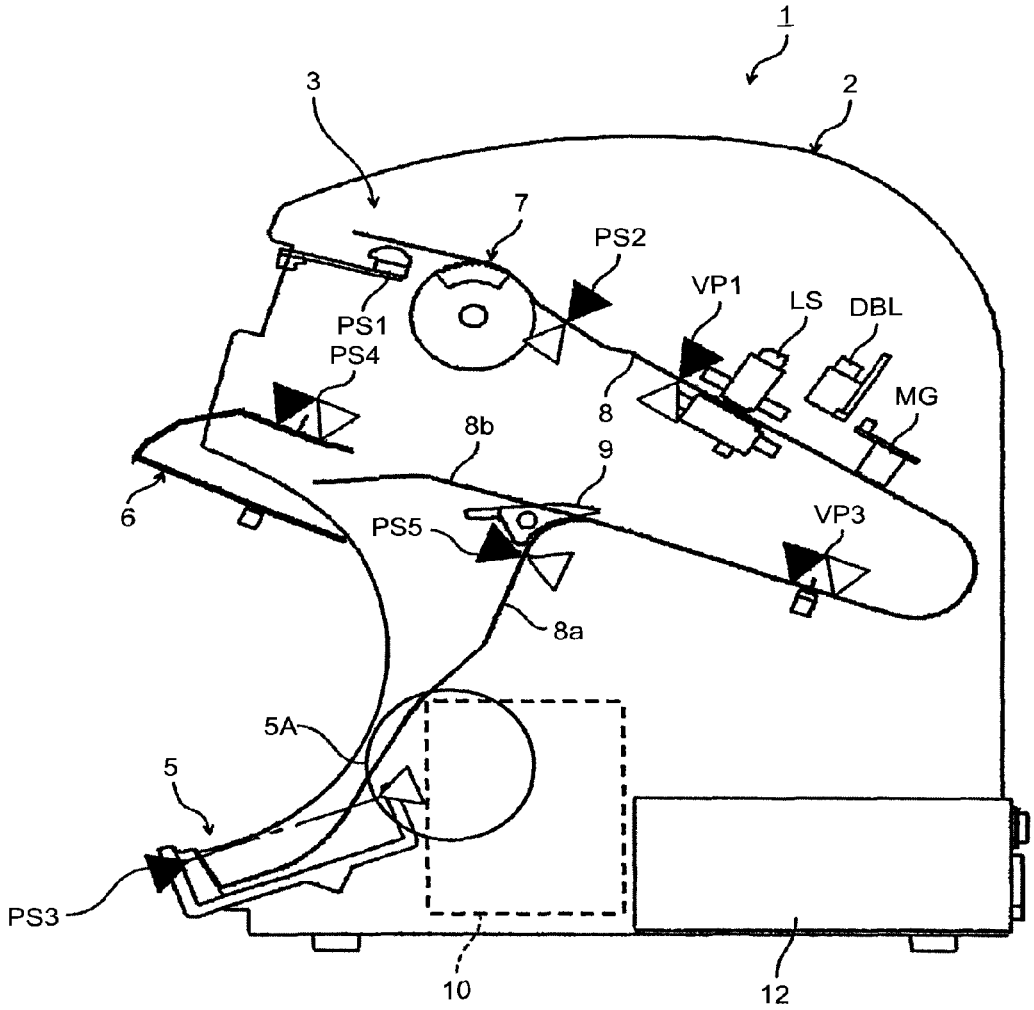
FIG. 2 is a simulated longitudinal sectional view of the bill recognizing and counting apparatus according to the present invention.

FIG. 2 is an explanatory diagram for schematically depicting a transporting mechanism inside the bill recognizing and counting apparatus 1 according to an embodiment of the present invention. In FIG. 2, the hopper 3 includes a hopper sensor PS1 that detects the presence of a bill, and a feeding mechanism 7 that sequentially feeds the bill filled in the hopper 3 from the bottom. The feeding mechanism 7 operates in response to a detection signal from the hopper sensor PS1 or an operation of the operation buttons 4A to feed the bills filled in the hopper 3 to a transport path 8 formed inside the bill recognizing and counting apparatus 1. Power is transmitted to a roller constituting the feeding mechanism 7 via a clutch, so that the roller feeds the bills for a predetermined period, and brakes to prevent follow-up running or double feeding of bills.

Arranged in the transport path 8 are optical sensors PS2 to PS5, VP1, and VP3 including a projector and a photodetector for detecting an abnormal state of the bill being transported (jamming of bills and the like) and the position of the bill.

The feed control sensor PS2 arranged immediately after (on a downstream side) of the feeding mechanism 7 is used for control of the clutch and a brake in the feeding mechanism 7, and the recognition control sensors VP1 arranged on the downstream of the feed control sensor PS2 are used for detecting a bill length (size) and a skew degree of the bill to be transported. Arranged on the downstream of the recognition control sensors VP1 are a line sensor LS and magnetic sensors MG constituting a part of a recognizing section, and a double-feed detection sensor DBL that detects whether plural bills are being fed in a stacked state. The line sensor LS includes a reflective sensor using three visible lights of red light, green light, and blue light and a transmission sensor using infrared light, and is used for recognizing the type of the bill P and detecting a direction and a bill width $P_w$ (size in X-direction orthogonal to the transport direction). Meanwhile, the magnetic sensors MG are used for recognizing the authenticity of the bill.

The bill having been subjected to recognition and detection by the various sensors described above is dispatched to the rejecting unit 6 or the stacker 5 by a flipper 9 (a branching member) arranged at a point where the transport path 8 is branched to the rejecting unit 6 and the stacker 5. When a front edge of the bill reaches the distribution control sensor VP3, a solenoid is driven to swing the flipper 9, thereby switching the transport path 8 from a main transport path 8*a* (toward the stacker 5) to a branched transport path 8*b* (toward the rejecting unit 6). The bill determined to be normal by the recognizing section (the bill to be recognized as the counting target) is transported through the flipper 9 along the main transport path 8*a*, and aligned and stacked in the stacker 5 by the impeller 5A after a counter is counted up at a point in time when passing through the counting sensor PS5. On the other hand, the bill determined to be a different type or abnormal by the recognizing section (the bill to be excluded from the counting target) is transported along the branched transport path 8*b* to the rejecting unit 6, because the solenoid is operated to swing the flipper 9 as the branching member downward. The presence of the bill in the stacker 5 is detected by the stacker sensor PS3, and the presence of the bill in the rejecting unit 6 is detected by the rejecting unit sensor PS4.

The feeding mechanism of the bill and the impeller 5A are driven by a main motor 10 provided in a lower part of the casing 2. The main motor 10 is stopped when the various sensors described above detect abnormality such as jamming or skewed transport. A power unit 12 that drives the solenoid of the flipper 9, the main motor 10, the various sensors, and a controller described later is provided also in the lower part of the casing 2.

Figure 3:
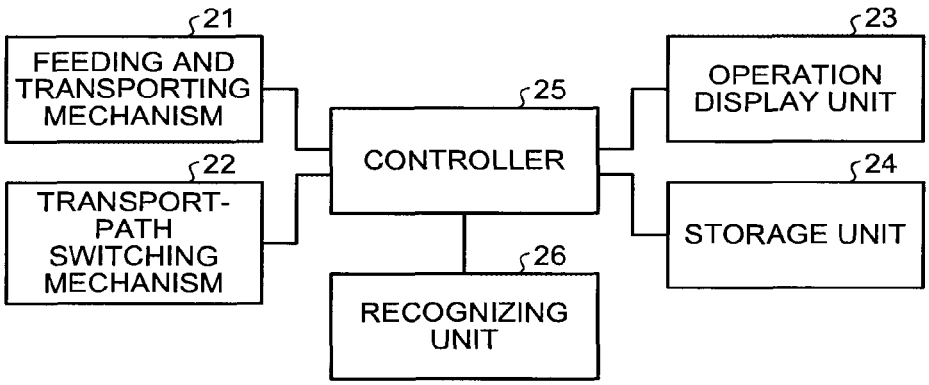
FIG. 3 is a block diagram of a configuration example of a main part of the bill recognizing and counting apparatus according to the present invention.

FIG. 3 is a block diagram of a configuration example of a main part of the bill recognizing and counting apparatus according to the present invention. A feeding and transporting mechanism 21 includes the hopper 3, the stacker 5, the rejecting unit 6, the feeding mechanism 7, a transporting mechanism including the transport path 8 and a transport roller (not shown), and the main motor 10 as a drive source, and feeds and transports the bills received in the hopper 3 to the transport path 8 one by one. The feeding and transporting mechanism 21 in the present embodiment has a continuously or two or more discretely variable speed function, so that a transport interval and transport speed of the bill can be controlled according to a drive command from outside. Further, a feed operation and a transport operation of the bill in the feeding and transporting mechanism 21 are operated relative to one another, and when a drive stop command is received from outside, the feed operation and the transport operation is stopped synchronously.

A transport-path switching mechanism 22 includes the swingable branching member (the flipper 9), the solenoid as the drive source and others. By activating the solenoid, the transport path is switched from the main transport path 8*a* to the branched transport path 8*b* shown in FIG. 2, and the transport path is held on the branched transport path 8*b* side while operating the solenoid. The transport-path switching mechanism 22 is also configured such that by stopping the operation of the solenoid, the transport path is returned to the main transport path 8*a* side and is held on the main transport path 8*a* side, while the operation of the solenoid is stopped.

An operation display unit 23 (an operation display unit 4 in FIG. 1) is provided with buttons required for an operator's operation, such as setting of bill processing modes (a denomination mode, a counting mode and the like), and also has a display unit (display panel 4B) for displaying a processing result and the like. A storage unit 24 stores therein data and programs required for denomination recognition and authenticity determination of the bills and a counting result of the bills, and is constituted by predetermined recording media such as a ROM and RAM.

The control unit constituting a controller 25 controls respective mechanisms and respective units connected thereto with a predetermined program, and for example, a microprocessor can be used therefor. In the present embodiment, the denomination mode for recognizing the denomination, the counting mode for performing only counting, the different-denomination recognition mode for recognizing a different denomination, and an authenticity determination mode for determining the authenticity are provided as the bill processing modes. The controller 25 controls a processing speed, which indicates the number of bills to be processed per unit time, to be different between the denomination mode and other modes (the counting mode, the different-denomination recognition mode, and the authenticity determination mode). Specifically, when the bill processing mode is in any one of the modes other than the denomination mode, the controller 25 performs control for increasing the processing speed, which indicates the number of bills to be processed per unit time, by setting the feeding and transporting mechanism 21 to a higher speed than the speed set in the denomination mode, where the increase in speed is in accordance with a reduced time necessary to process a reduced amount of data associated with the denomination mode (data processing amount in a denomination recognizing process or an authenticity determining process).

In the counting mode, the different-denomination recognition mode, and the authenticity determination mode, the controller 25 prohibits a switching operation to a branched transport path by the transport-path switching mechanism 22, so that the bill is guided to a normal bill the stacker (the stacker 5 shown in FIGS. 1 and 2) through the main transport path at all times. When detecting a bill not satisfying a predetermined condition in the above respective modes, the controller 25 sets an error flag indicating abnormality detection and performs control for stopping the bill recognizing and counting apparatus. A more lenient criterion than that for the different-denomination recognition mode is set as the criterion for abnormality at that time. It is because abnormality (skew of bill, or bill being folded or being partially damaged) other than the double feed can be accurately counted and there is low possibility of erroneous counting in, for example, the counting mode. The same can be true for the different-denomination recognition mode and the authenticity determination mode, and accurate different-denomination check and authenticity determination can be performed even if a lenient abnormality criterion is set as compared to criterion of the different-denomination recognition mode. Note that the "different denomination check" as referred to in the present invention means checking whether the denomination of all bills to be processed is the same. In other words, it is checked whether a bill of a different denomination is mixed in the bills to be processed.

On the other hand, in the denomination mode, the controller 25 controls the switching timing to the branched transport path by driving the transport-path switching mechanism 22 to be earlier than normal, when detecting a bill in a skewed state exceeding a predetermined criterion.

A recognizing unit 26 performs processes such as denomination recognition of the bill, different denomination recognition (the different denomination check), authenticity determination, and counting by receiving detection signals of the respective sensors under the control of the controller 25. At this time, the recognizing unit 26 uses control parameters set corresponding to the respective modes to perform process according to the bill processing mode. For example, the recognizing unit 26 does not performed a particular process or performs reject determination of the bill by using a corresponding determination threshold. A configuration in which the controller 25 is incorporated in the recognizing unit 26 is also included in the present invention.

An operation of the feeding and transporting mechanism 21 is explained next.

Figure 4:
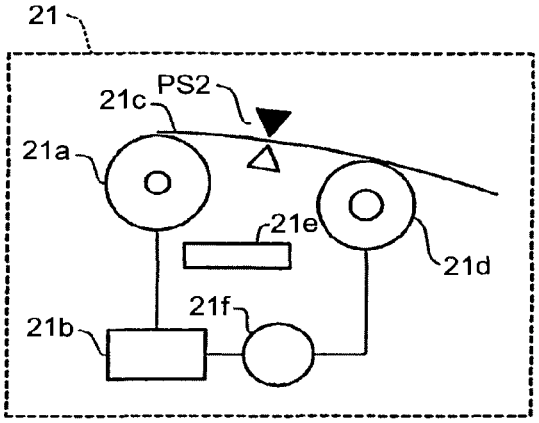
FIG. 4 is a schematic diagram of a configuration example of a main part of a feeding and transporting mechanism according to the present invention.

FIG. 4 is a configuration example of a main part of the feeding and transporting mechanism 21, and the feeding and transporting mechanism 21 includes a feed roller 21*a*, a clutch/brake 21*b* for controlling a feed interval, a transport path 21*c* (a transport path 8, a main transport path 8*a*, and a branched transport path 8*b*), a transport roller 21*d*, a feed control sensor PS2, an encoder 21*e* that detects the transport speed, and a motor 21*f* (a main motor 10) as a drive source. The feed roller 21*a* and the transport roller 21*d* are driven by one motor 21*f* and operated relative to one another.

Figure 5:
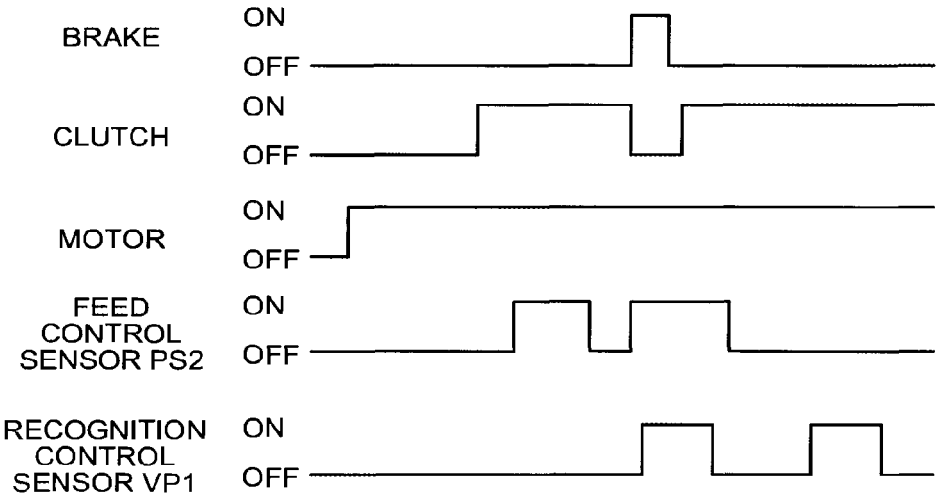
FIG. 5 is a timing chart for explaining control of a transport interval and transport speed of bills.

FIG. 5 is a timing chart for explaining control of a transport interval and transport speed of the bill. At the time of feeding the bill, the feed roller 21*a* is intermittently operated by the clutch/brake 21*b*, so that the bill is fed to the transport path one by one with a predetermined interval. The transport speed is detected by the encoder 21*e*, and drive of the motor 21*f* is controlled such that the transport speed becomes predetermined speed. In the present embodiment, the transport interval and the transport speed are adjusted such that the transport interval of the bill is, for example, 55 millimeters or less in the denomination mode, 15 millimeters or less in the counting mode and the like, and the processing speed of the bill (the number of bills per unit time which passes through the feed control sensor PS2) is 720 sheets/minute in the denomination mode and 1200 sheets/minute in the counting mode, the different-denomination recognition mode, and the authenticity determination mode. The feed interval and the transport speed can be changed by a command from the controller 25, and can be varied during the operation of the feeding and transporting mechanism 21. For example, when determining that the bill interval detected by the feed control sensor PS2 is smaller than a predetermined threshold, the controller 25 instructs the feeding mechanism 7 to turn on the clutch, and controls such that the bill interval becomes a regular interval. As a result, the waveform of the recognition control sensor VP1 arranged immediately before the line sensor LS has equal intervals as shown in FIG. 5, and each bill is scanned by the line sensor LS synchronously with an output of the recognition control sensor VP1.

Figure 6:
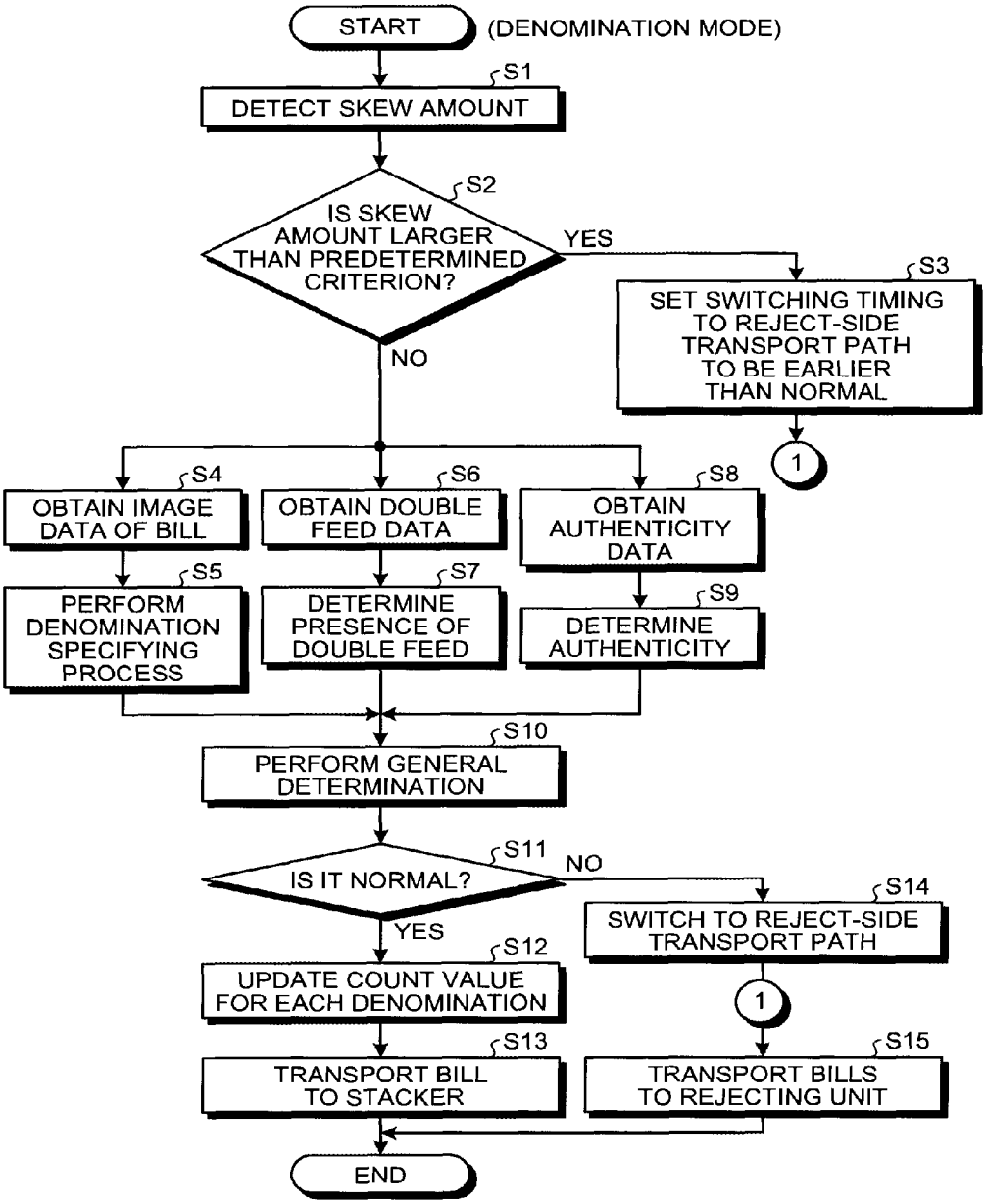
FIG. 6 is a flowchart for explaining an operation example of the bill recognizing and counting apparatus when a denomination mode is designated.

In such a configuration, an operation of the bill recognizing and counting apparatus when the denomination mode is designated is explained along a flow of a flowchart in FIG. 6, with reference to FIG. 2. An operation example of the bill recognizing and counting apparatus is explained along the flow of the bill mainly for characteristic matters in the present invention, and explanations of a specific denomination recognition process and the like will be omitted.

A plurality of bills received collectively by the hopper 3 of the bill recognizing and counting apparatus is fed to the transport path one by one and transported along the route of the transport path 8 with the predetermined interval. When the front edge of the bill reaches the recognition control sensor VP1, the skew degree (skew amount) of the bill is detected (Step S1), and it is determined whether the skew amount exceeds a predetermined criterion (Step S2).

At Step S2, when the skew degree of the bill exceeds the predetermined criterion, a transport destination of the bill is switched to the branched transport path 8*b* by driving the transport-path switching mechanism 22 (the branching member 9 operated by the solenoid), without waiting for arrival of the bill to the line sensor LS constituting a portion of the identifying unit, thereby guiding the bill to the rejecting unit 6.

The reason why such a control is performed is described below.

It is because the denomination recognition may not be possible with respect to the bill having a very high skew degree even if scanning is performed by the line sensor LS, that is, there is a strong possibility that the bill will be rejected.

In the present embodiment, the processing speed of the bill is set high in the counting mode, the different-denomination recognition mode, and the authenticity determination mode, which does not involve denomination recognition, however, even in the denomination mode, the processing speed of the bill is set faster than in the conventional bill recognizing and counting apparatus. Accordingly, if the branching member (the flipper 9 in FIG. 2) is driven by the solenoid after the bill has passed the position of the line sensor LS as in the conventional machine, a distance between a preceding part of the bill and the branching member becomes too close to each other due to skew, and the switching operation of the transport-path switching mechanism by driving the branching member may not be performed in time.

Figure 7:
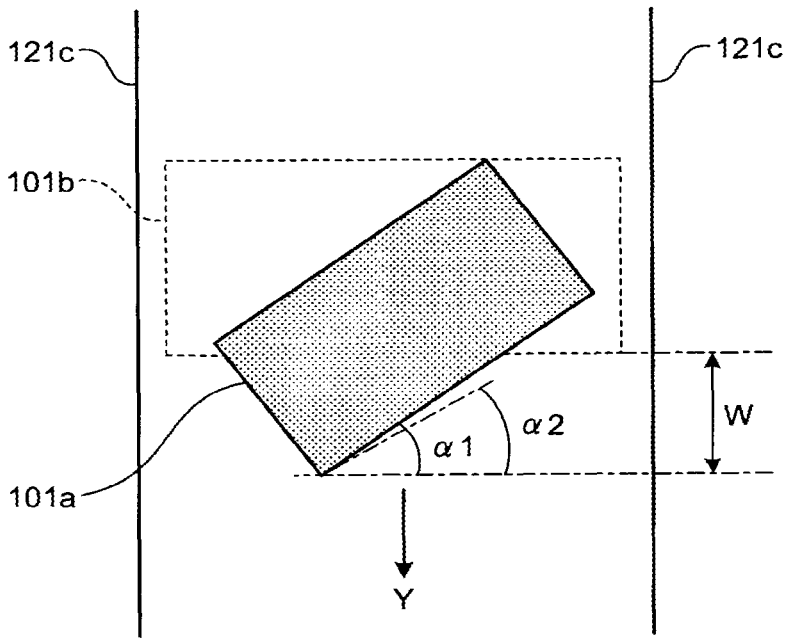
FIG. 7 is an explanatory diagram of a process when a bill in a skewed state is detected.

For example, as shown in FIG. 7, for a bill 101*b* having a large size in a direction orthogonal to a transport direction Y (the size in a lengthwise direction), the skew thereof is controlled by the width regulating guide 121*c*, and thus the skew amount of the bill 101*b* can be within a certain range. However, for a bill 101*a* having a small size, the skew thereof cannot be controlled by the width regulating guide, the bill may be transported with a very high skew degree. In an example in FIG. 7, a length of the bill 101*a* in the transport direction Y becomes longer than the bill 101*b* (for example, a bill having the largest size) having no skew by size W in FIG. 7. In the present embodiment, therefore, when it is determined that the skew amount (skew angle $\alpha 1$ in FIG. 7) exceeds a predetermined criterion (threshold $\alpha 2$ of the skew angle), the solenoid of the transport-path switching mechanism is operated at this point in time, to switch the transport destination of the bill to the branched transport path 8*b*, so that the bill is guided to the rejecting unit 6.

In other words, conventionally, in the processing using the respective sensors (in this example, the line sensor LS, the double-feed detection sensor DBL, and the magnetic sensor MG) provided on the downstream side of the recognition control sensor VP1, when the predetermined criterion is not satisfied, the switching control of the transport destination at the time of rejecting in the recognizing unit is executed at the same timing (for example, at a timing when the front edge of the bill reaches the distribution control sensor VP3). The operation time of the switching mechanism has been a factor of causing jamming of bills or hindering speed-up of the entire processing. However, in the present embodiment, when it is determined that the skew amount exceeds the predetermined criterion, the switching timing to the branched transport path 8*b*, which is the transport path toward the rejecting unit 6, is set earlier than normal (at the time of detecting abnormality other than the skew), thereby switching the transport direction to the branched transport path 8*b* before the bill passes through the line sensor LS, which is a member of the recognizing unit (Step S3), so that the skewed bill is guided to the rejecting unit 6 via the branched transport path 8*b*.

Jamming can be prevented and the speed of the transport system can be further increased by performing such switching control. Further, because the distance between the recognizing unit and a branch point of the transport path can be decreased by size W in FIG. 7, the downsizing of the casing can be realized.

Meanwhile, at Step S2, the denomination recognition process, the determining process of the presence of the double feed, and the authenticity determining process performed by the recognizing unit 26 are simultaneously performed in parallel with respect to the bill determined as having less skew degree, that is, the bill with the skew amount being within a predetermined range, under the control of the controller 25.

First, in the denomination recognition process, when the bill is scanned by the line sensor LS (Step S4), an image obtained by the scan is compared with data in a denomination recognition table to specify the denomination of the bill (Step S5). A data processing time is required for the denomination recognition process, and in the present embodiment, the processing speed is controlled to 720 sheets/minute. However, the entire processing speed is increased as compared to the conventional bill recognizing and counting apparatus that does not perform control of the switching timing.

On the other hand, in the determining process of the presence of the double feed, the recognizing unit 26 obtains detection data of the double-feed detection sensor DBL (Step S6), and compares the detection data (for example, information indicating a thickness of the bill) with the determination criterion value (threshold) to check whether the bill is only one, that is, two or more bills are not stacked on each other (double feed) (Step S7).

Meanwhile, in the authenticity determining process, the recognizing unit 26 detects a magnetic component of the bill (presence of a magnetic ink or the like) by the magnetic sensor MG and compares a detection result with a threshold to perform the authenticity determination (Steps S8 and S9).

The recognizing unit 26 obtains a determination result of the denomination at Step S5, a determination result of the double feed at Step S7, and a determination result of the authenticity at Step S9, thereby generally determining whether the bill is a normal bill (Steps S10 and S11). When the bill is determined to be normal at Step S11, a counter for each denomination is updated at a point in time when the bill passes through a counting sensor PS5 (Step S12), and the bill is aligned and stacked in the stacker 5 by an impeller 5A (Step S13). On the other hand, at Step S11, when it is determined that the bill is not normal, the transport destination of the bill is switched to the branched transport path 8*b* (Step S14), and the bill is transported to the rejecting unit 6 (Step S15).

An operation when the mode other than the denomination mode is designated is explained next. A difference in the operation between the modes other than the denomination mode and the denomination mode is explained with reference to an example of control parameters in the respective modes.

In the present embodiment, the counting mode, the different-denomination recognition mode, and the authenticity determination mode are included as the bill processing modes other than the denomination mode. However, because a speed-up process of the processing speed, an abnormality determining process based on a lenient determination criterion, and the process at the time of abnormality determination in the three modes are the same, the counting mode is explained as an example.

Table 1 schematically shows an example of a difference in the bill processing mode in the respective modes. As the control parameters, pieces of information as shown in Table 1 are initially set with respect to the respective modes.

TABLE 1

| Mode | Speed | Branching | Skew angle | Double sheets detection | Denomination recognition | Authenticity determination |
|---|---|---|---|---|---|---|
| Denomination mode | Fast | ON | Lenient | For each denomination | Present | Present |
| Counting mode | Slow | OFF | Strict | Compared with first sheet | None | None |

In the present embodiment, as shown in the example of Table 1, the control parameters (feed and transport speed, presence of prohibition of the switching operation to the branched transport path 8*b*) relating to the transport system of the bill, and the control parameters (threshold of the skew angle, the processing mode of double sheets detection (double feed detection), the presence of the denomination recognition process, and the presence of the authenticity determining process) of the recognizing unit are set for each mode and stored in the storage unit.

As shown in Table 1, in the counting mode, the determination criterion (detection condition of the skew angle) in the abnormality detection is eased as compared to the denomination mode, thereby increasing a passage rate of the bill as the normal bill. As the determination criteria not shown in Table 1, there is a determination criterion of the bill size used for determining the bill being partially damaged or the like. A size determination criterion (threshold) in a widthwise direction is set strictly in the denomination mode, but is set leniently in the counting mode. As a size determination criterion in a lengthwise direction, there is size determination (determining process is executed) in the denomination mode, whereas there is no size determination (determining process is not executed) in the counting mode. In this manner, the respective determination criteria are set.

Figure 8:
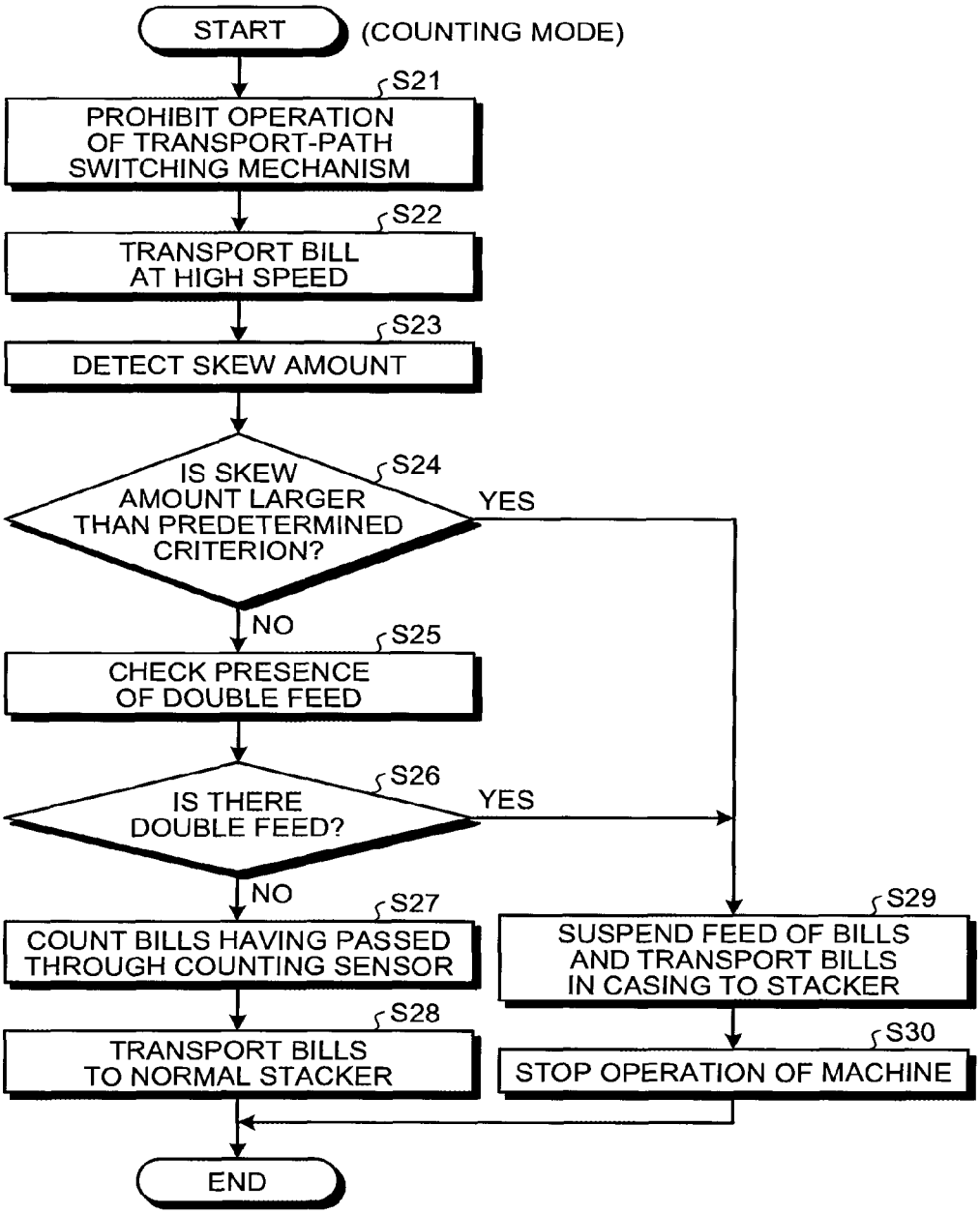
FIG. 8 is a flowchart for explaining an operation example of the bill recognizing and counting apparatus when a counting mode is designated.

The operation of the bill recognizing and counting apparatus when the counting mode is designated is explained along a flow of a flowchart in FIG. 8 with reference to FIG. 2. The difference from the denomination mode is explained, and explanations will be omitted for the same operations as in the denomination mode.

In the counting mode, it is desired to perform control such that the drive of the branching member (the flipper 9 in FIG. 2) by the solenoid is prohibited during the counting mode. In the present embodiment, the switching operation of the feeding and transporting mechanism by driving the branching member is prohibited, that is, the branching member is fixed such that the transport destination is the stacker 5 (stacker for normal bills) at all times (Step S21). In the counting mode, because a switching operation time at the time of rejecting the bill (an operation time of the transport-path switching mechanism for switching to the branched transport path 8*b* side and returning to the main transport path 8*a*) is reduced to none, as compared to the denomination mode, the transport speed can be speeded up in accordance with the reduced time.

A plurality of bills collectively received in the hopper 3 of the bill recognizing and counting apparatus is fed into the transport path one by one, and transported along the route of the transport path 8 with the predetermined interval. At that time, the controller increases the feed speed and the transport speed of the bills, and performs control such that the respective bills are transported at high speed on the transport path 8 (Step S22).

In the counting mode, the controller detects the skew amount of the bill by the recognition control sensor VP1 (Step S23), and determines whether the skew amount exceeds the predetermined criterion (Step S24).

At Step S24, when the skew angle of the bill does not exceed the predetermined criterion, the double-feed detection sensor DBL checks whether there is double feed (in the present embodiment, checks if there is a bill being folded or damaged by determining the widthwise size of the bill as another check) (Steps S25 and S26). When there is no double feed, the bills having passed through the counting sensor PS5 are counted (Step S27), and the bills are received by the impeller 5A and stacked in the stacker 5 (Step S28). In the counting mode, the bill passes through the line sensor LS and the magnetic sensor MG; however, because data processing based on these sensor outputs, that is, the denomination recognition process and the authenticity determining process in the recognizing unit are not performed at all, the processing speed in the counting mode can be increased by a time necessary to process data associated with the denomination recognition process and the authenticity determining process. The processing speed in the counting mode in the present embodiment is set to 1200 sheets/minute.

On the other hand, at Step S24 or S26, when the bill does not satisfy the condition for regarding the bill as normal (when double feed or the like occurs), an error flag is set and feed of the bill is suspended by turning off the clutch connected to the feed roller. After it is checked whether there is no bill being processed in the casing and all the bills have been transported to the stacker based on the detection signals of the respective optical sensors PS2 to PS5, VP1, and VP3 (Step S29), the drive of the main motor 10 as a transport drive source is suspended to suspend the operation of the apparatus (the feeding and transporting mechanism or the like) (Step S30). At that time, for example, information indicating the type of abnormality and a detected position are displayed on the operation display unit to notify this matter to an operator.

The recognition process of the different denomination in the different-denomination recognition mode and the authenticity determining process in the authenticity determination mode are explained next.

In the different-denomination recognition mode and the authenticity determining process, a difference in the detection data between the first bill and each of the second bill thereafter is compared with the determination criterion (allowable range), based on at least one piece of information of the detection data indicating the characteristic of the bill first encountered in each mode (in the present embodiment, (a) the size of the bill, (b-1) presence of magnetism, (b-2) presence of reaction to the light of the infrared region, and (b-3) color (R, G, and B), to identify whether the bill is of a different denomination from that of the first bill (in the authenticity determination mode, authenticity determination) based on a comparison result. In this example, the detection data components (a), (b-2), and (b-3) are obtained from image data of the bill extracted by the line sensor LS, and the component (b-1) of the detection data is obtained by the magnetic sensor MG.

In the present embodiment, the determination criterion in the different-denomination recognition mode is set more lenient than that in the denomination mode so that the passage rate of the bill as the normal bill is increased as in the counting mode. Each of the determination criteria (allowable ranges) can be changed to the allowable range specified by an operator to conform to conditions of bills in each country.

As described above, in the bill recognizing and counting apparatus according to the present invention, the processing speed in the denomination mode is set lower than that in the counting mode, and the processing speed in the counting mode, the different-denomination recognition mode, and the authenticity determination mode is set high. In each of the modes in which the processing speed is increased, jamming is reduced by prohibiting the switching operation to the branched transport path, and the data processing amount is reduced by not performing the data processing such as the denomination recognition process or the like, thereby increasing the processing speed in accordance with the reduced time necessary to process the reduced data processing amount. In the respective modes, parameters which can be hardly used for recognition but can be used for counting in the denomination mode (or parameters which can be used for different denomination recognition or parameters which can be used for authenticity determination) are used, and determination criteria of the parameters (determination criterion of skew or the like) are set leniently, thereby suppressing the occurrence of unnecessary rejecting. Further, in the denomination mode, the switching timing to the branched transport path is set faster than normal, thereby decreasing the occurrence of jamming.

In the present embodiment, in the modes other than the denomination mode, a case that the switching operation to the branched transport path is prohibited at all times during execution of the mode has been described as an example. However, a prohibited state of the switching operation can be dynamically changed such that prohibition of the switching operation to the branched transport path is released when the size exceeds the determination criterion. That is, in the counting mode, the different-denomination recognition mode, and the authenticity determination mode, the skew angle and the size of the bill are included in determination thresholds used as a reject condition, and these determination thresholds are set such that a reject rate becomes lower than that in the denomination mode. When the determination thresholds are exceeded, the prohibition state of the switching operation is temporarily released to operate the transport-path switching mechanism, so that the bill is guided to a stacker in the rejecting unit. In this case, an opportunity of driving the branching member decreases by setting a lenient determination criterion for the parameters used for rejection, and the occurrence of jamming can be reduced. When the lenient determination criterion is set for the parameter in the counting mode or the like, prohibition of the switching operation to the branched transport path can be released at all times. In the counting mode, the different-denomination recognition mode, the authenticity determination mode, and the denomination mode (or in any one mode), the drive of the feeding and transporting mechanism of the bill is controlled according to the type of the parameters used for rejection, so that the transport speed of the bill is temporarily set to be low, to further decrease the occurrence of jamming in the branching unit. The configuration in which a detecting process of the skew is performed in any mode has been explained. However, if the highest leniency of a skew determination criterion is set in the modes other than the denomination mode, a configuration in which the detecting process of the skew is not performed can be employed.

INDUSTRIAL APPLICABILITY

The bill recognizing and counting apparatus according to the present invention is designed for the bills. However, the present invention can be also applied to an recognizing and counting apparatus designed for paper sheets other than the bills (securities and cash vouchers such as gift certificates). Further, while the present invention is preferably applied to a desktop bill recognizing and counting apparatus as shown in the drawings, the present invention is also applicable to widely-used bill recognizing and counting apparatus having a general size.

The invention claimed is:

1. A bill recognizing and counting apparatus comprising:

an operation unit configured to receive a setting of a given bill processing mode from a plurality of bill processing modes, wherein the plurality of bill processing modes includes a denomination mode in which a denomination of a bill is recognized, and a counting mode in which a number of the bill is counted without recognizing the denomination of the bill;

a feeding and transporting unit configured to feed and transport a given bill;

a transport-path switching unit configured to switch a transport route of the given bill from a main transport path to a branched transport path;

a detecting unit configured to detect a skew of the given bill;

a recognizing unit configured to perform, according to the given bill processing mode, at least one of a denomination recognition process and a counting process; and a control unit configured to perform a control function such that 1) when the given bill processing mode is the denomination mode, the transport-path switching unit is driven to guide the given bill to the main transport path when a skewed state of the given bill does not exceed a predetermined criterion, and to guide the given bill to the branched transport path when the skewed state of the given bill exceeds the predetermined criterion, and 2) when the given bill processing mode is the counting mode, the transport-path switching unit is driven to guide the given bill to the main transport path regardless of the skewed state of the given bill.

2. The bill recognizing and counting apparatus according to claim 1, wherein, when the given bill processing mode is the counting mode, the control unit is configured to prohibit the recognizing unit from recognizing the denomination of the given bill such that a data processing amount per bill in a counting process of the bills is reduced.

3. The bill recognizing and counting apparatus according to claim 1, wherein the predetermined criterion is a permissible level of skew for the denomination of the given bill to be recognized.

4. A bill recognizing and counting apparatus comprising:

a rejecting unit for rejected bills;

a transport-path switching unit configured to switch a route of a given bill from a main transport path to a branched transport path toward the rejecting unit;

a detecting unit configured to detect a skew of the given bill;

an operation unit configured to receive a setting of a given bill processing mode from a plurality of bill processing modes, wherein the plurality of bill processing modes includes a denomination mode in which a denomination of the given bill is recognized, and a counting mode in which a number of the given bill is counted without recognizing the denomination of the given bill;

a recognizing unit configured to perform, according to the given bill processing mode, at least one of a denomination recognition process and a counting process; and a control unit configured to drive the transport-path switching unit to guide the given bill to the rejecting unit through the branched transport path when the given bill is in a skewed state exceeding a predetermined criterion as detected by the detecting unit in the denomination mode;

wherein a first criterion set as the predetermined criterion in the denomination mode is different from a second criterion set as the predetermined criterion in the counting mode, wherein the second criterion in the counting mode is set to be more lenient than the first criterion in the denomination mode such that a reject rate in the counting mode becomes lower than a reject rate in the denomination mode.

5. The bill recognizing and counting apparatus according to claim 4, wherein the control unit is configured to detect an abnormal state from a plurality of abnormal states, the plurality of abnormal states includes the skewed state and at least one of a folded state, a partially-damaged state, and a double feed state, and wherein, when the given bill in the skewed state is detected in the denomination mode, the control unit is configured to set a switching timing of the transport-path switching unit to the branched transport path to be earlier than a switching timing when the given bill is in an abnormal state other than the skewed state.

6. The bill recognizing and counting apparatus according to claim 4, wherein, when the given bill processing mode is the denomination mode, the control unit is configured to provide a control function such that the transport-path switching unit is driven to guide the given bill to the rejecting unit through the branched transport path when the given bill is in the skewed state exceeding the first criterion as detected by the detecting unit.

7. The bill recognizing and counting apparatus according to claim 4, wherein each of the first criterion and the second criterion is a permissible level of skew for the denomination of the given bill to be recognized.

8. The bill recognizing and counting apparatus according to claim 4, wherein the second criterion is a function of an ability of the recognizing unit to perform the counting of bills in the counting mode.

9. The bill recognizing and counting apparatus according to claim 4, wherein when the given bill processing mode is the counting mode, and the skewed state of the given bill exceeds the second criterion, the control unit is configured to stop operation of the bill recognizing and counting apparatus.

10. A method for processing bills using a bill recognizing and counting apparatus having a stacker for normal bills and a rejecting unit for rejected bills, comprising:

selecting one of a denomination mode in which a denomination of a bill is recognized and a counting mode in which a number of the bill is counted without recognizing the denomination of the bill, as a processing mode of the bill recognizing and counting apparatus;

transporting a given bill received in the bill recognizing and counting apparatus along a transport path of the bill recognizing and counting apparatus;

detecting a skew of the given bill via a detecting unit provided on the transport path;

performing at least one of denomination recognition process and a counting process by a recognizing unit;

stacking, when either the counting mode or the denomination mode is selected, the given bill into the stacker when a skewed state of the given bill does not exceed a first predetermined criterion for the denomination mode or a second predetermined criterion for the counting mode;

stacking the given bill into the stacker, when the counting mode is selected, when the skewed state of the given bill exceeds the second predetermined criterion; and stacking the given bill into the rejecting unit, when the denomination mode is selected, when the skewed state of the given bill exceeds the first predetermined criterion, wherein the first predetermined criterion is a function of an ability of the recognizing unit to recognize the denomination of the given bill in the denomination mode.

11. The method according to claim 10, wherein the second predetermined criterion in the counting mode is set to be more lenient than the first predetermined criterion in the denomination mode such that a reject rate in the counting mode becomes lower than a reject rate in the denomination mode.

12. The method according to claim 10, further comprising stopping the bill recognizing and counting apparatus when the counting mode is selected and the skewed state of the given bill exceeds the second predetermined criterion.

* * * * *